US008950907B2

(12) United States Patent
Packard et al.

(10) Patent No.: US 8,950,907 B2
(45) Date of Patent: Feb. 10, 2015

(54) CONVERTIBLE LIGHTING FIXTURE FOR MULTIPLE LIGHT SOURCES

(71) Applicant: Level Solutions, LLC, Fishers, IN (US)

(72) Inventors: David J. Packard, Noblesville, IN (US); William E. Nagengast, Anderson, IN (US); James S. Mellinger, Anderson, IN (US); Judy Nagengast, Anderson, IN (US)

( * ) Notice: Subject to any disclaimer, the term of this patent is extended or adjusted under 35 U.S.C. 154(b) by 62 days.

(21) Appl. No.: 13/913,030

(22) Filed: Jun. 7, 2013

(65) Prior Publication Data

US 2013/0329434 A1 Dec. 12, 2013

Related U.S. Application Data

(60) Provisional application No. 61/657,490, filed on Jun. 8, 2012.

(51) Int. Cl.

| | |
|---|---|
| ***F21V 15/00*** | (2006.01) |
| ***F21V 19/04*** | (2006.01) |
| ***F21V 17/00*** | (2006.01) |

(52) U.S. Cl.

CPC ..... *F21V 19/04* (2013.01); *F21V 17/002* (2013.01)

USPC ..... 362/362; 362/227; 362/234

(58) Field of Classification Search

USPC ..... 362/362, 227, 235, 373

See application file for complete search history.

(56) References Cited

U.S. PATENT DOCUMENTS

| | | | |
|---|---|---|---|
| 2005/0259416 | A1 | 11/2005 | Gauna et al. |
| 2009/0213588 | A1 | 8/2009 | Manes |
| 2009/0303711 | A1 | 12/2009 | Remus et al. |
| 2010/0002452 | A1 | 1/2010 | Gananathan et al. |
| 2010/0127637 | A1 | 5/2010 | Alexander et al. |
| 2010/0182786 | A1 | 7/2010 | Hein |

*Primary Examiner* — Joseph L Williams

(74) *Attorney, Agent, or Firm* — Christopher R. Powers

(57) ABSTRACT

A convertible lighting fixture includes a first housing defining a first compartment, a second housing defining a second compartment and movably attached to the first housing, the second housing having a surface adjacent the first compartment. The lighting fixture further includes a mounting plate attached to the second housing and at least partially separating the second compartment from a third compartment, a light source mechanically attached to the mounting plate and electrically connected to a power source disposed within the first compartment, and a cover defining the third compartment and substantially surrounding the light source, the cover reversibly attached to the second housing opposite the first housing, where the first, second, and third compartments are arranged to thermally insulate the power source from the light source.

20 Claims, 8 Drawing Sheets

CONVERTIBLE LIGHTING FIXTURE FOR MULTIPLE LIGHT SOURCES

CROSS-REFERENCE TO RELATED APPLICATION

This U.S. utility patent application claims the priority benefit of U.S. Provisional Patent Application Ser. No. 61/657,490, filed Jun. 8, 2012.

TECHNICAL FIELD OF THE INVENTION

The present disclosure generally relates to wide area lighting fixtures and, more specifically, to convertible lighting fixtures.

BACKGROUND

Wide area lighting fixtures are commonly used for both indoor and outdoor applications. Indoor lighting such as those used in arenas, gymnasiums, aircraft hangers, and other large spaces use wide area lighting. Outdoor lighting fixtures, such as those used for street lighting, parking structures, loading dock areas, and other exterior lighting applications, also use wide area lighting and may be known in such applications as canopy lights. These wide area fixtures typically involve a light source, such as a bulb, lamp, or other illumination source, a transformer for converting a power supply to the light source's power requirements, and a reflector and/or lens system to direct the light output from the light source into a desired illumination pattern. When the fixtures are elevated and their light output directed downward, a wide area can be illuminated by strategic placement of the fixtures.

The types of wide area lighting fixtures vary depending upon the particular application and lighting requirements, as do the light sources employed. High Intensity Discharge ("HID") fixtures, for example, are one of the most prevalent outdoor lighting fixtures in use today and may include metal halide, high pressure sodium, and low pressure sodium light sources. As an example, metal halide lamps produce approximately 70-115 lumens per Watt with operating life expectancies approximately in the 5,000-20,000 hour range. By comparison, high pressure sodium lamps produce about 50-140 lumens per Watt on average with an operating life expectancy of approximately 24,000-40,000 hours. Maintaining these types of fixtures can be expensive due to the cost of the replacement light sources themselves and the labor and equipment (e.g., boom trucks, lane flashers to rear, caution area markers, etc.) needed to reach the fixtures, which are often in difficult to reach locations, and to disassemble them to replace the proper component.

Another type of light source used for wide area lighting is induction lighting. Induction lighting is similar to fluorescent lighting in that induction lighting uses the excitation of a contained gas or gases, which react with phosphors inside a lamp to produce white light. However, induction lamps excite the gases using a magnetic field, as opposed to electrodes as in fluorescent lighting. Induction lamps are rated up to 100,000 hours operating life and, consequently, are typically employed where maintenance of the lamp is problematic. Moreover, induction lamps are energy efficient, typically operating at greater than 85 lumens per Watt. Further, induction lamps exhibit high lumen maintenance over the entire life and provide instant on and instant restrike capability, such that there is virtually no warm up time.

Yet another type of light source used for wide area lighting is the light-emitting diode ("LED") array. The efficacy of LEDs, as measured in lumens per Watt, is rapidly evolving, and more powerful LEDs are being released every 6-12 months. Currently, LEDs are approaching efficacies of 130 lumens per Watt with a rated operating life of 50,000-100,000 hours. However, individual, discrete LEDs do not produce sufficient light output to illuminate a wide area. As a result, to produce sufficient illumination in most applications, prior art solid-state lighting systems utilize many LEDs, such as clusters of LEDs arranged in arrays on printed circuit boards. However, these clusters create significant heat that can build up and damage the LEDs unless the heat is controlled and dissipated. Consequently, most LED lighting manufacturers mount the LEDs to large, heavy heat sinks. If an individual LED malfunctions it is not efficiently replaceable and cannot be simply unscrewed and replaced as with other types of light sources. Furthermore, as newer, brighter, higher efficacy LEDs come on the market, the entire prior art LED array requires replacement, and likely a complete heat sink redesign, because the supporting heat sink system is most often constructed as a single integrated unit. Today, few modularized lighting systems are available that allow for upgrades to the newest LED technology without completely developing new components for the entire system. Consequently, there is significant expense in both materials and labor to either replace a non-LED fixture with one incorporating LEDs or to upgrade a current LED fixture to the latest technology, as it will generally require an entirely new LED array and heat sink system designed to handle a new and more powerful LED.

Accordingly, a need exists for a modular convertible lighting fixture that can be easily and effectively converted to use one of multiple high-efficiency light sources by replacing only the light source and associated electronics without the need to completely remove the fixture from its mounted location. Further, there is a need for a convertible lighting fixture that is easily and cost-effectively maintained and upgraded to the latest high-efficiency lighting technology without replacing the entire fixture.

SUMMARY

According to one aspect of the present disclosure a convertible lighting fixture is disclosed. In at least one embodiment, a lighting fixture includes a first housing defining a first compartment and a second housing defining a second compartment and movably and removably attached to the first housing, the second housing having a surface adjacent the first compartment. A lighting fixture further includes a cover reversibly attached to the second housing opposite the first housing, the cover defining a third compartment thermally insulated from the first compartment by the second compartment. In at least one embodiment, the lighting fixture includes a plate attached to the second housing and at least partially separating the second compartment from a third compartment, and a light source mechanically attached to the plate and electrically connected to a power source disposed within the first compartment.

In at least one embodiment, the first, second, and third compartments are configured to enable the light source within the third compartment to be replaced without accessing the first or second compartments. In at least one embodiment, the first, second, and third compartments are configured to enable the power source within the first compartment to be replaced without accessing the second or third compartments. In at least one embodiment, the lighting fixture further includes at least one slip hinge, removably attaching the first and second housings, and a locking screw attached to either the first or second housings and disposed adjacent the at least one slip hinge, whereby the locking screw prevents disassembly of the slip hinge.

In at least one embodiment, the cover comprises a plurality of optical elements capable of directing light emitted by the light source into a desired light distribution. In at least one embodiment, the plate is adapted to enable the attachment of different types of light sources. In at least one embodiment, the light source is a fluorescent induction tube disposed within at least one induction coil, and the power source is a ballast. In at least one embodiment, the light source is at least one light-emitting diode module, and the power source is a light-emitting diode driver, including voltage and current control.

BRIEF DESCRIPTION OF THE DRAWINGS

The described embodiments and other features, advantages and disclosures contained herein, and the manner of attaining them, will become apparent and the present disclosure will be better understood by reference to the following description of various exemplary embodiments of the present disclosure taken in conjunction with the accompanying drawings, wherein.

Like reference numerals indicate the same or similar parts throughout the several figures.

Figure 1:
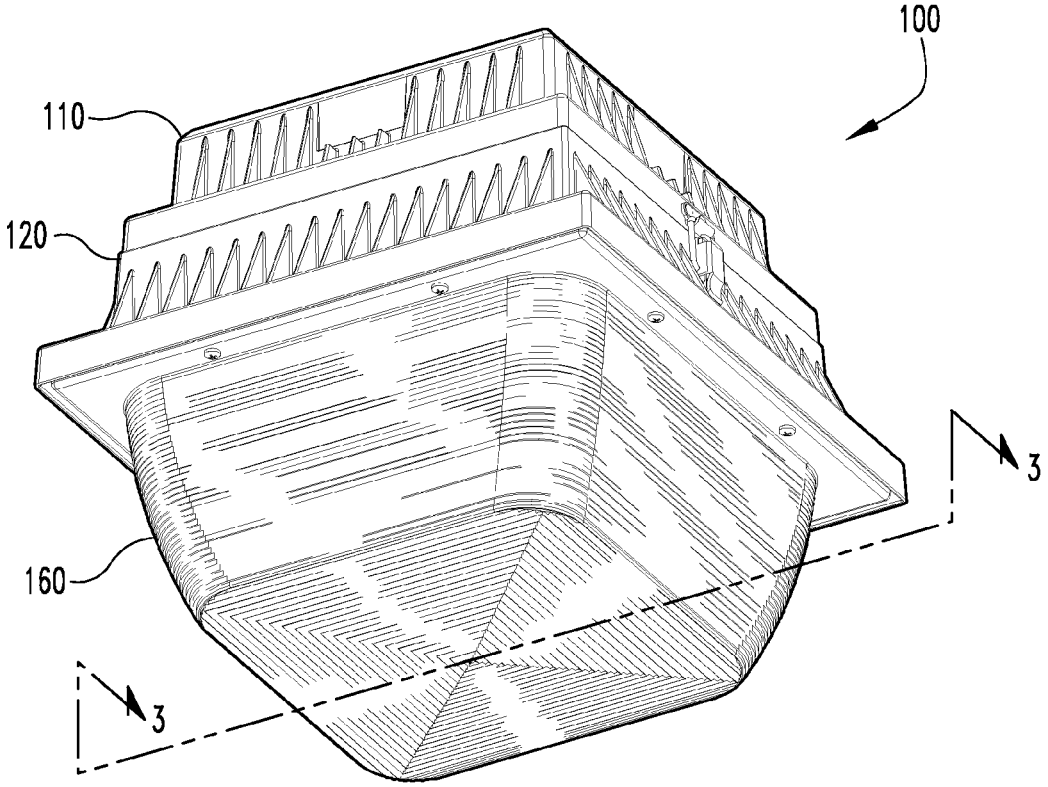
FIG. 1 shows a perspective view of a convertible lighting fixture according to an embodiment of the present disclosure.

An overview of the features, functions and configuration of the components depicted in the various figures will now be presented. It should be appreciated that not all of the features of the components of the figures are necessarily described. Some of these non-discussed features, such as various fasteners, etc., as well as discussed features are inherent from the figures. Other non-discussed features may be inherent in component geometry or configuration.

DETAILED DESCRIPTION

For the purposes of promoting an understanding of the principles of the present disclosure, reference will now be made to the embodiments illustrated in the drawings, and specific language will be used to describe the same. It will nevertheless be understood that no limitation of the scope of this disclosure is thereby intended.

The disclosure of the present application provides a convertible lighting fixture for multiple light sources. The convertible lighting fixture of the present disclosure provides a modular light fixture that can be converted to use one of multiple high-efficiency light sources by simply replacing only the light source and its associated power electronics and without the need to completely remove the fixture from its mounting location, thereby facilitating both conversion and servicing of the fixture. Further, the convertible lighting fixture of the present disclosure enables the light source to be upgraded without replacing the entire fixture. These features of the convertible lighting fixture are enabled by a three-compartment configuration that provides advantages over conventional lighting fixtures, including of ease of maintenance, thermal isolation of the ballast or driver electronics from the light source, and prevention of foreign material intrusion into the light source compartment. Further advantages of the convertible lighting fixture are disclosed herein.

Figure 2:
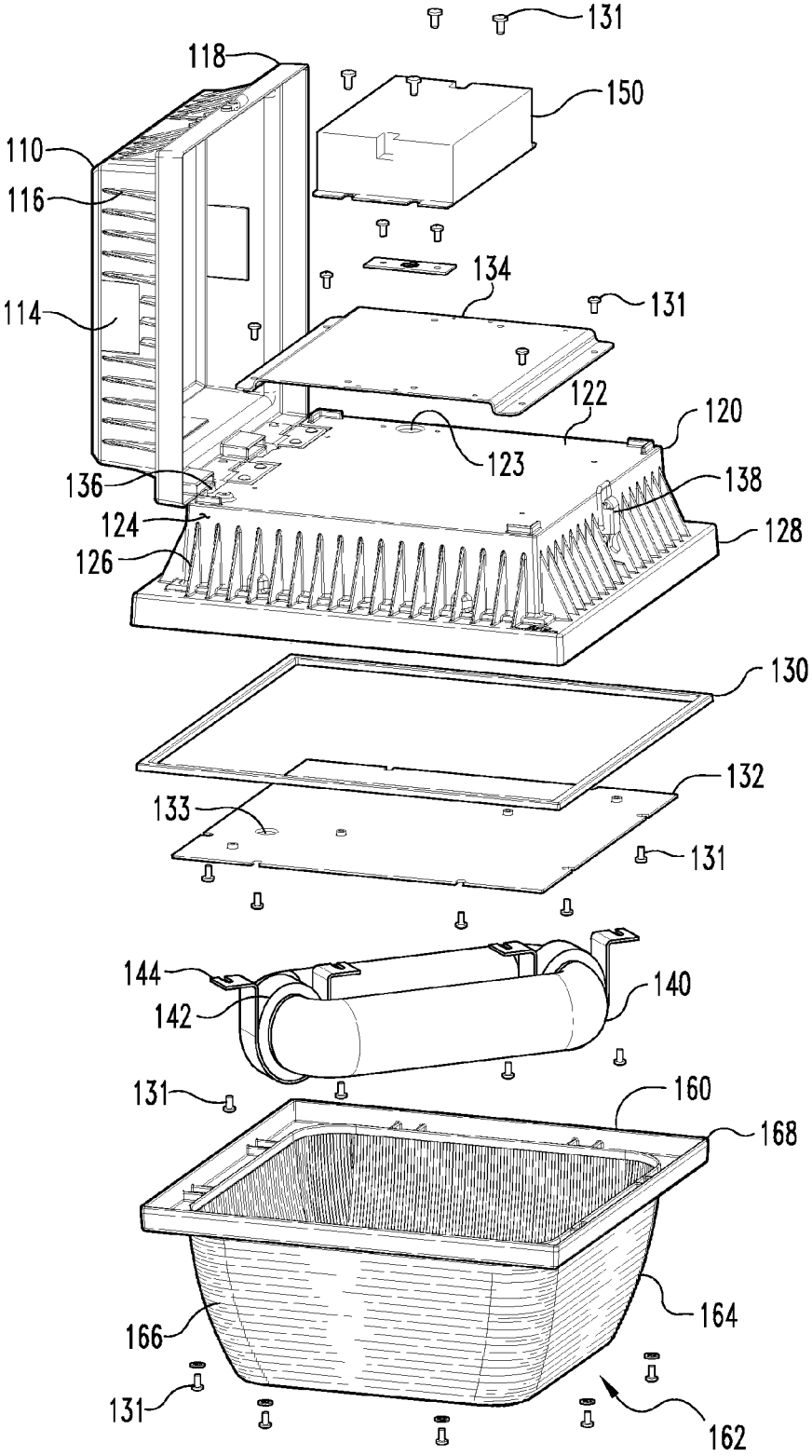
FIG. 2 shows an exploded perspective view of a convertible lighting fixture according to an embodiment of the present disclosure.
Figure 3:
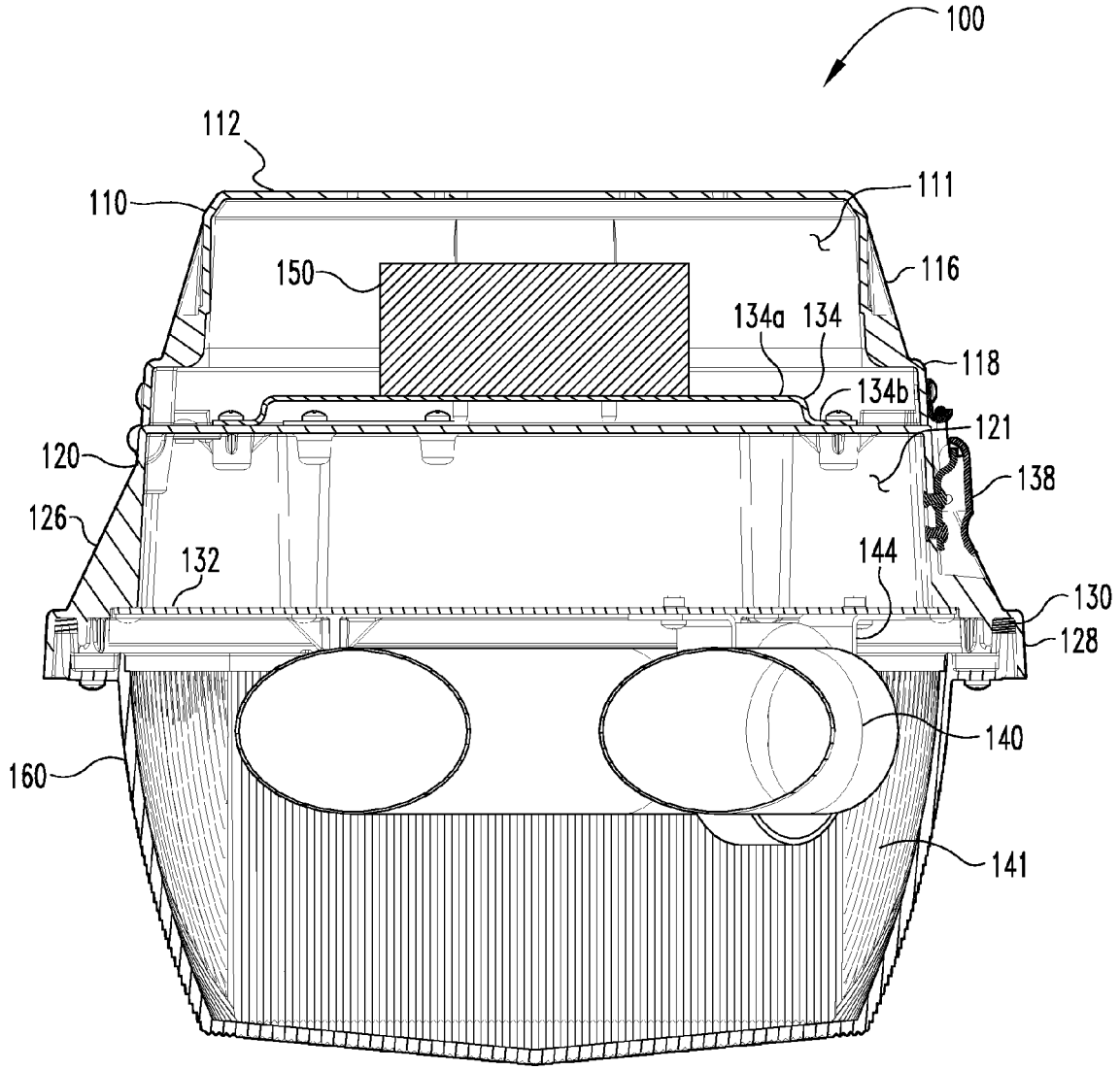
FIG. 3 shows a cross-sectional view of a convertible lighting fixture according to an embodiment of the present disclosure taken through the centerline at section line 3-3 as shown in FIG. 1.

A convertible lighting fixture according to at least one embodiment of the present disclosure is shown in FIGS. 1-3. As shown in FIG. 1, a convertible lighting fixture 100 includes a lens cover 160 reversibly attached to a lower housing 120, which is movably attached to an upper housing 110. As shown in FIGS. 2-3, the upper housing 110 includes a top surface 112 with upper walls 114 extending in one direction from the edges of the top surface 112. The top surface 112 and upper walls 114 define a ballast compartment 111 therebetween. The upper housing 110 may further include an upper flange 118 extending from the periphery of the upper walls 114 opposite the top surface 112.

The lower housing 120 includes a mounting surface 122 with lower walls 124 extending in one direction from the edges of the mounting surface 122. The mounting surface 122 and lower walls 114 define an insulating compartment 121 therebetween. The mounting surface 122 may be sized such that a perimeter of the mounting surface 122 is smaller than an inner perimeter of the upper flange 118 wherein, when assembled, the mounting surface 122 fits within the inner perimeter of the upper flange 118. The lower housing 120 may further include a lower flange 128 extending from the periphery of the lower walls 124 opposite the mounting surface 122. Moreover, the upper and lower housings 110, 120 may be movably attached to one another by at least one hinge 136 or other suitable means disposed along an edge of the mounting surface 122 and an adjacent edge of the upper flange 118. Aside from the hinge 136, the upper and lower housings 110, 120 may be reversibly secured together by a latch 138 or other suitable means when assembled. The latch 138 may include a locking feature to prevent unwanted opening or vandalism of the fixture 100. Such locking feature may include a locking drawbolt, a loop configured for a padlock, security wire, or zip tie, or another suitable locking feature that prevents the unlatching of the latch 138.

Figure 4:
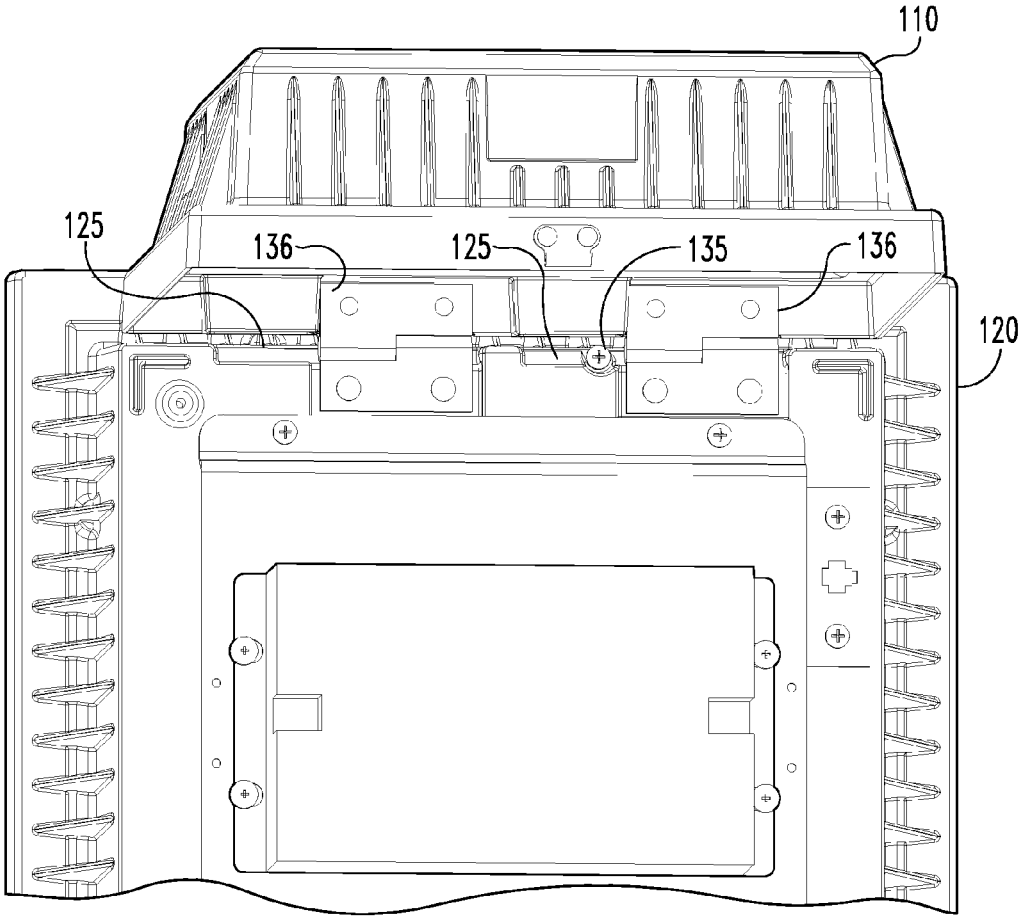
FIG. 4 shows a partial top view of a convertible lighting fixture according to an embodiment of the present disclosure with the upper housing in the open configuration.

The at least one hinge 136 may be a slip hinge, which enables the upper and lower housings 110, 120 to be disassembled from one another easily. As shown in FIG. 4, the lower housing 120 may have a channel 125 formed therein adjacent to each hinge 136 to provide clearance for one half of the hinge 136 to slide relative to the other half, thereby easily separating the upper housing 110 from the lower housing 120. To prevent tampering or accidentally disassembly of the hinge 136, a lock screw 135 may be attached to the lower housing 120 within the channel 125 to block the hinge from sliding and disengaging. Alternatively, the channel 125 may be formed in, and the lock screw 135 attached to, the upper housing 110 with the same effect. The channel 125 and lock screw 135 may be configured such that, when fully engaged, the lock screw 135 is flush with the surface of the channel 125, and thus the halves of hinge 136 may slide freely past one another and disengage. Moreover, by partially backing out the lock screw 135, it may interfere with the sliding halves of the hinge 136, thereby preventing its disassembly. Further, the lock screw 135 may be a security fastener with a tamper-resistant head requiring special tools to engage and disengage the lock screw 135.

Consequently, the at least one slip hinge 136 enables installation and maintenance of the upper housing 110 separate from the lower housing 120 with subsequent assembly of the housings 110, 120. For example, a single person may first secure the upper housing 110 in the desired location for the fixture 100. With the upper housing 110 prepositioned, power connections may be made to the fixture 100 before the lower housing 120, including the remaining components of the fixture 100, is attached to the prepositioned upper housing 110. Conventional lighting fixtures require a two-man installation and maintenance process with one person making connections while the other supports the weight of the fixture. Such a two-man process may be particularly difficult in wide area lighting applications where the fixtures are located high off the ground or in other difficult to reach locations.

The lens cover 160 may form a bowl-like shape with a lens flange 168 at the brim, which corresponds to the shape of the lower flange 128, a lens wall 164 forming the sides of the bowl-like shape, and a lens bottom 162 that extends between and caps the lens wall 164 to form the bottom of the bowl-like shape. The lens bottom 162 and lens wall 164 define a lamp compartment 141. The lens flange 168 is formed to engage the lower housing 120 and may be reversibly attached to the lower housing 120 by any suitable means, including but not limited to screws 131. The lens flange 168 may engage the lower housing 120 within the perimeter of the lower flange 128, thereby protecting the interface therebetween from direct exposure to the environment and minimizing potential intrusion into the fixture 100. Further, the lens wall 164 and lens bottom 162 may include a plurality of optical elements 166 formed therein that distribute the light output from a light source 140 into a desired light pattern. Alternatively, the lens cover 160 may include a surface treatment, such as frosted or stippling, to provide diffusion of the light emitted from the light source 140. To enable the desired light distribution, the lens cover 160 may be made of a substantially optically transparent or at least translucent material, including but not limited to glass, cyclic olefin copolymer (COC), polymethylmethacrolate (PMMA), polycarbonate (PC), PC/PMMA composite, silicones, fluorocarbon polymers, and polyetherimide (PEI), or other suitable material.

In addition to enabling the desired light distribution, the lens cover 160 further protects the lamp compartment 141 from intrusion of foreign material into the lamp compartment 141. Moreover, a seal 130 may be disposed between the lens cover 160 and the lower housing 120 such that, when assembled, the seal 130 prevents the intrusion of dirt, water, insects, or other foreign matter into the lamp compartment 141. The seal 130 may be made of any suitably resilient material capable of maintaining a seal between the lens cover 160 and the lower housing 120, preferably for the life of the convertible light fixture 100.

In at least one embodiment according to the present disclosure, the convertible lighting fixture 100 includes an induction fluorescent light source 140 disposed within the lamp compartment 141. The fluorescent light source 140 may be an electrodeless tube filled with a mixture of inert gas and mercury vapor. Such fluorescent lighting technology is well-known in the art, and examples include ICETRON® products from Osram-Sylvania. The light source 140 includes at least one induction coil 142 surrounding a portion of the light source 140. One or more mounting bands 144 surround the at least one induction coil 142 and attach the light source 140 to a mounting plate 132, which in turn is attached to the lower housing 120. The mounting plate 132 may include a reflective surface on the side facing the light source 140 capable of reflecting incident light from the light source 140.

In at least one embodiment according to the present disclosure, the convertible lighting fixture 100 includes an isolation plate 134 and a ballast 150 mounted within the ballast compartment 111 as shown in FIG. 3. The isolation plate 134 includes a flat portion 134*a*, upon which the ballast 150 is attached, and at least two base portions 134*b* offset at distance from the flat portion 134*a*. The base portions 134*b* may be attached to the mounting surface 122 of the lower housing 120 such that an insulating air gap exists between the flat portion 134*a* where the ballast 150 may be attached and the mounting surface 122. Thus, the isolation plate 134 serves to thermally isolate the ballast from the lower housing 120 and thereby the light source 140. The isolation plate 134 and the ballast 150 may be attached by any suitable means including but not limited to screws 131.

The ballast 150 includes solid state electronic circuitry to provide the proper starting and operating voltages to power the light source 140. The ballast 150 may include various power regulation functions as is well-known in the art, including changing the frequency of the power from the standard main frequency of 50-60 Hertz (Hz) to some higher frequency, such as 20,000 Hz, stepping the voltage supplied to the light source 140 from startup to steady state operation, and surge protection for the light source 140. However, a by-product of the ballast function is heat generated by the electronics during operation. The ballast 150 is electrically connected to a power supply line (not shown) and to the at least one induction coil 142 of the light source 140 via a wiring harness (not shown), which passes from the ballast compartment 111 through an opening 123 in the mounting surface 122 of the lower housing 120 and further through an opening 133 in the mounting plate 132 to the at least one induction coil 142.

In operation, the convertible lighting fixture 100 may be mounted in a desired location by attaching the upper housing 110 at top surface 112 by any suitable means, such as screws, to a ceiling, wall, or other desired surface and connecting an electrical power supply line to the input of the ballast 150. Power to the fixture 100 may be controlled, for example, manually via a wall switch or automatically via a photosensor located on the fixture 100 or a centrally-located photosensor that controls a bank of fixtures 100.

Replacement of the ballast 150 is the most common maintenance issue for induction fluorescent lighting fixtures generally. Should the fixture 100 require service, such as maintenance or repair, the ballast compartment 111 may be easily opened by unfastening the latch 138 on the lower housing 120, thereby enabling access to the ballast 150 and associated power connections located on the moving and accessible lower housing 120. Accordingly, the fixture 100 may be serviced without disturbing or affecting the lamp compartment 141. Consequently, servicing the fixture 100 is easier than conventional lighting fixtures that include ballast electronics. Moreover, because the electronics and electrical connections of the fixture 100 can serviced without disturbing or affecting the lamp compartment 141, the integrity of the seal 130 and the lamp compartment 141 is not compromised, which avoids the intrusion of foreign matter and other potential light source problems associated with the maintenance of conventional lighting fixtures in which the light source must be exposed to service the electronics. Similarly, in a situation where the light source 140 must be replaced, the lamp compartment 141 may be serviced without disturbing the ballast 150 and electrical connections in the ballast compartment 111.

Thermal energy generated by induction fluorescent light fixtures may potentially reduce the rated life of the components, as is common in conventional lighting fixtures. However, the convertible lighting fixture 100 includes features that improve the thermal energy management of the fixture in service. Because the ballast compartment 111 is separate from the lamp compartment 141, the light source 140 is effectively thermally insulated from the heat generated by the normal operation of the ballast 150. Heat transfer between the ballast and lamp compartments 111, 141 is further inhibited by the isolation plate 134, which enables the formation of an insulating layer of air between ballast 150 and the lower housing 120. Likewise, the mounting plate 132 enables further thermal isolation of the light source 140 from the heat generated by the ballast 150. In assembly, the mounting plate 132 and lower housing 120 define the insulating compartment 121, in which the air filling the insulating compartment 121 is effectively stagnant. Consequently, the insulating compartment 121, isolated from the lamp compartment 141 by the mounting plate 132, further insulates the ballast 150 from the light source 140.

In addition, the fixture 100 is constructed to conduct heat away from the light source and transfer that heat to the ambient environment. First, the upper and lower housings 110, 120, the mounting plate 132, and the isolation plate 134 are each made of thermally conductive material that readily conducts heat, such as steel, copper, aluminum, or other suitably conductive material, and may be manufactured by casting, forging, molding, machining, or other suitable process. Second, the upper and lower housings 110, 120, the mounting plate 132, and the isolation plate 134 are each attached to one another such that there is a continuous thermal path from the light source 140 to the exterior surface of the fixture 100. Third, as shown in FIG. 3, the upper walls 114 of the upper housing 110 include vertical cooling fins 116 formed therein that increase the surface area of the upper housing 110, thereby facilitating convective and radiative heat transfer from the upper housing 110 to the ambient environment. Similarly, the lower walls 124 of the lower housing 120 include vertical cooling fins 126 formed therein that increase the surface area of the lower housing 120, thereby further facilitating convective and radiative heat transfer from the lower housing 120 to the ambient environment. Fourth, the total mass of the fixture 100 represents a significant thermal capacitance that can absorb and sink a considerable amount of thermal energy, thereby retarding increased temperatures at the light source 140. As a result, the fixture 100 is capable of dissipating the heat generated by the light source 140 and the ballast 150, which consequently can be maintained within appropriate operating temperatures in service.

Figure 5:
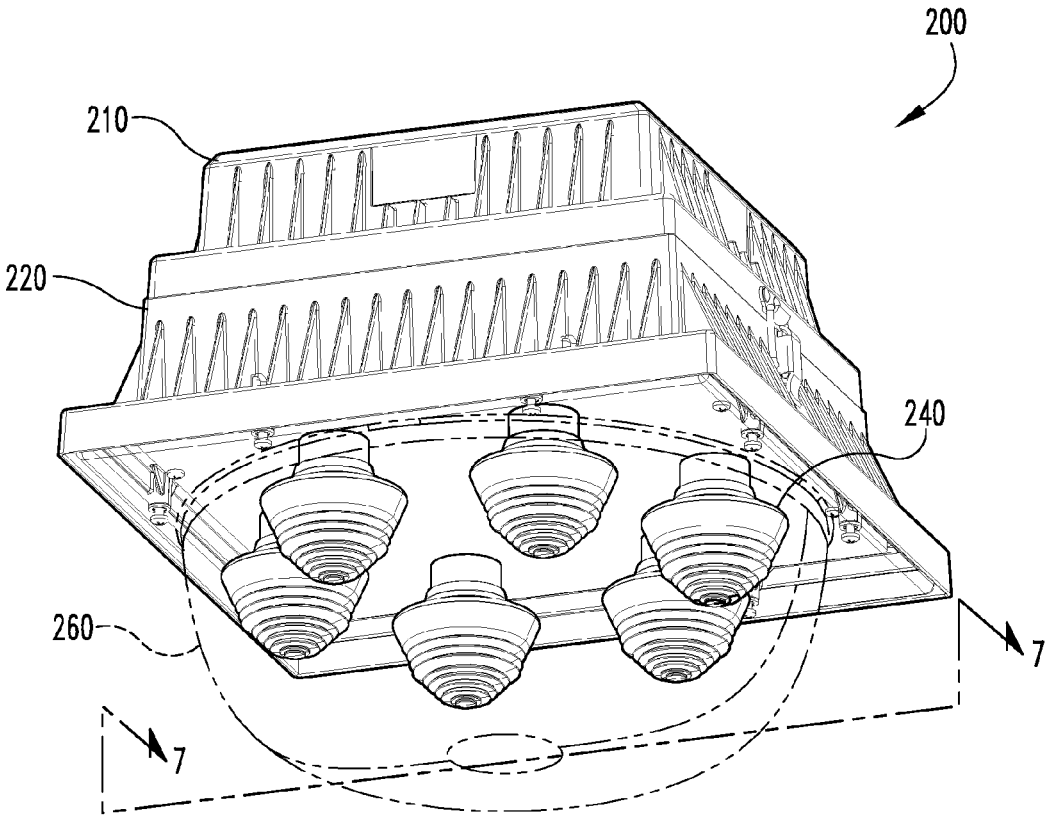
FIG. 5 shows a perspective view of a convertible lighting fixture according to an embodiment of the present disclosure.
Figure 6:
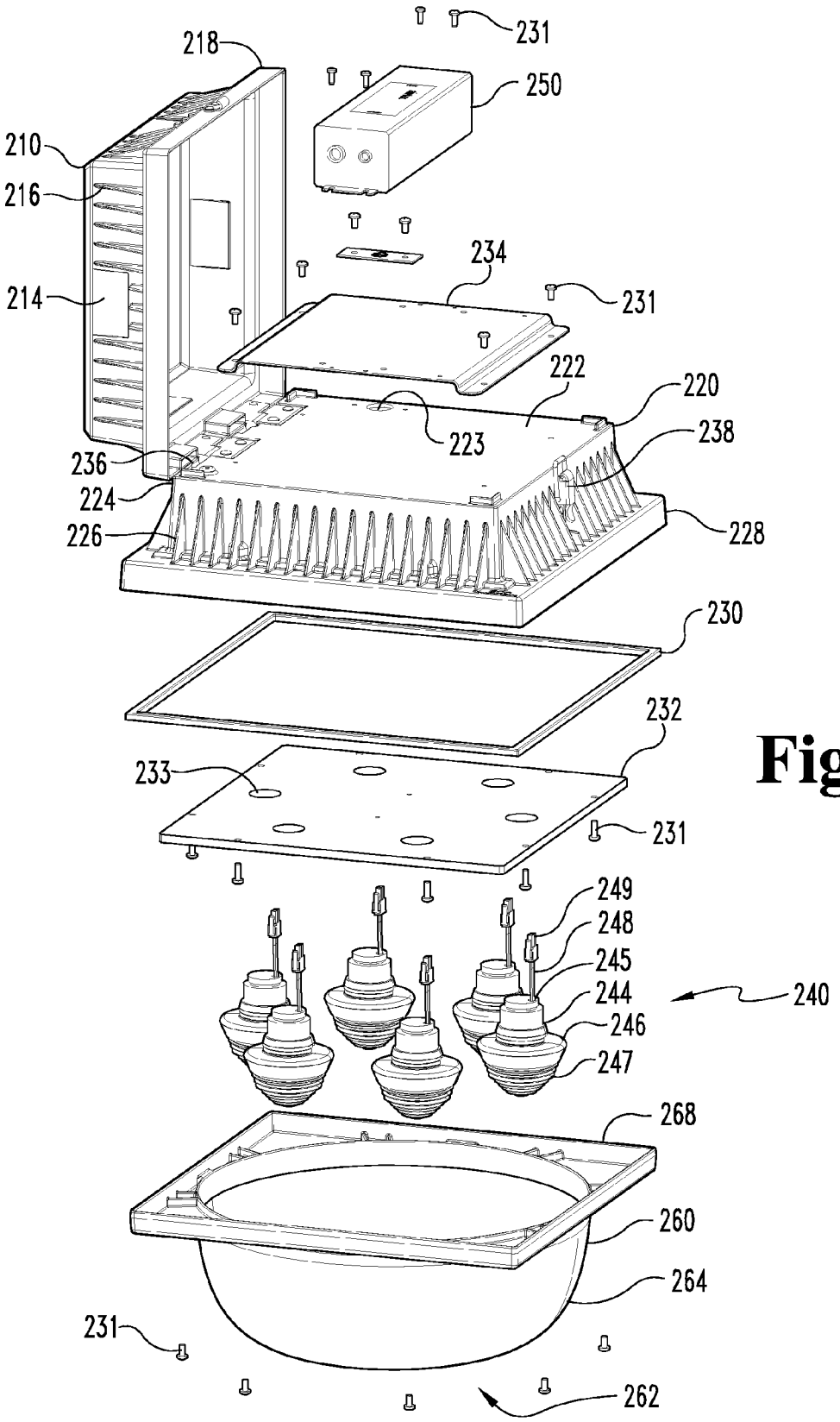
FIG. 6 shows an exploded perspective view of a convertible lighting fixture according to an embodiment of the present disclosure.
Figure 7:
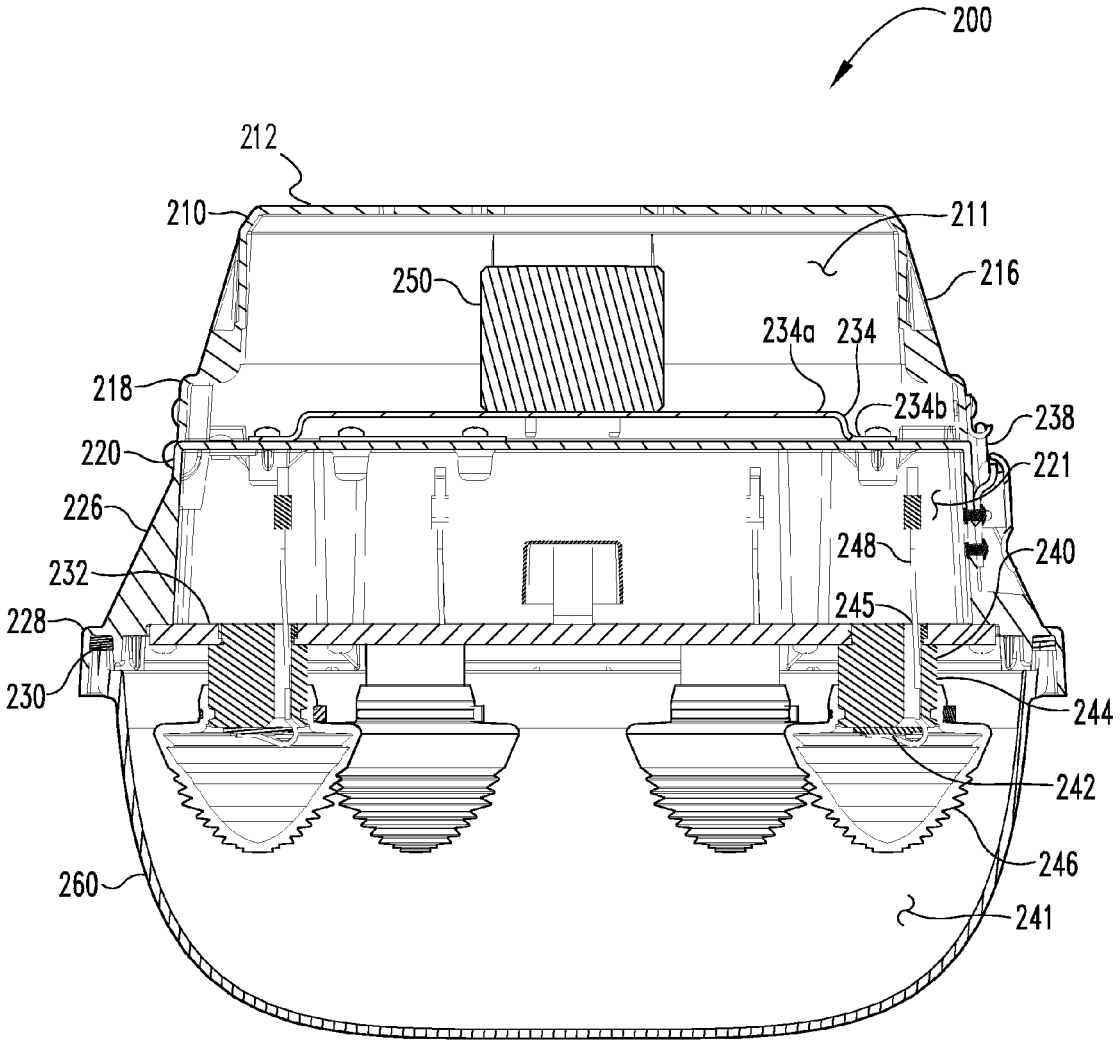
FIG. 7 shows a cross-sectional view of a convertible lighting fixture according to an embodiment of the present disclosure taken through the centerline at section line 7-7 as shown in FIG. 5.

The convertible lighting fixture 100 may be converted from using one type of light source to another easily and reliably by simply replacing certain components of the fixture assembly. Where the fixture 100 is depicted with an induction fluorescent light source 140 and associated ballast electronics 150 in FIGS. 1-3, a convertible lighting fixture may be converted to use a light-emitting diode ("LED") light source. A convertible lighting fixture 200 according to at least one embodiment of the present disclosure is shown in FIGS. 5-7. As shown in FIG. 5, a convertible lighting fixture 200 includes a lens cover 260 reversibly attached to a lower housing 220, which is movably attached to an upper housing 210. As shown in FIGS. 6-7, the upper housing 210 includes a top surface 212 with upper walls 214 extending in one direction from the edges of the top surface 212. The top surface 212 and upper walls 214 define a driver compartment 211 therebetween. The upper housing 210 may further include an upper flange 218 extending from the periphery of the upper walls 214 opposite the top surface 212.

The lower housing 220 includes a mounting surface 222 with lower walls 224 extending in one direction from the edges of the mounting surface 222. The mounting surface 222 and lower walls 214 define an insulating compartment 221 therebetween. The mounting surface 222 may be sized such that a perimeter of the mounting surface 222 is smaller than an inner perimeter of the upper flange 218 wherein, when assembled, the mounting surface 222 fits within the inner perimeter of the upper flange 218. The lower housing 220 may further include a lower flange 228 extending from the periphery of the lower walls 224 opposite the mounting surface 222. Moreover, the upper and lower housings 210, 220 may be movably attached to one another by at least one hinge 236 or other suitable means disposed along an edge of the mounting surface 222 and an adjacent edge of the upper flange 218. Aside from the hinge 236, the upper and lower housings 210, 220 may be reversibly secured together by a latch 238 or other suitable means when assembled. The latch 238 may include a locking feature to prevent unwanted opening or vandalism of the fixture 200. Such locking feature may include a locking drawbolt, a loop configured for a padlock, security wire, or zip tie, or another suitable locking feature that prevents the unlatching of the latch 238.

Figure 8:
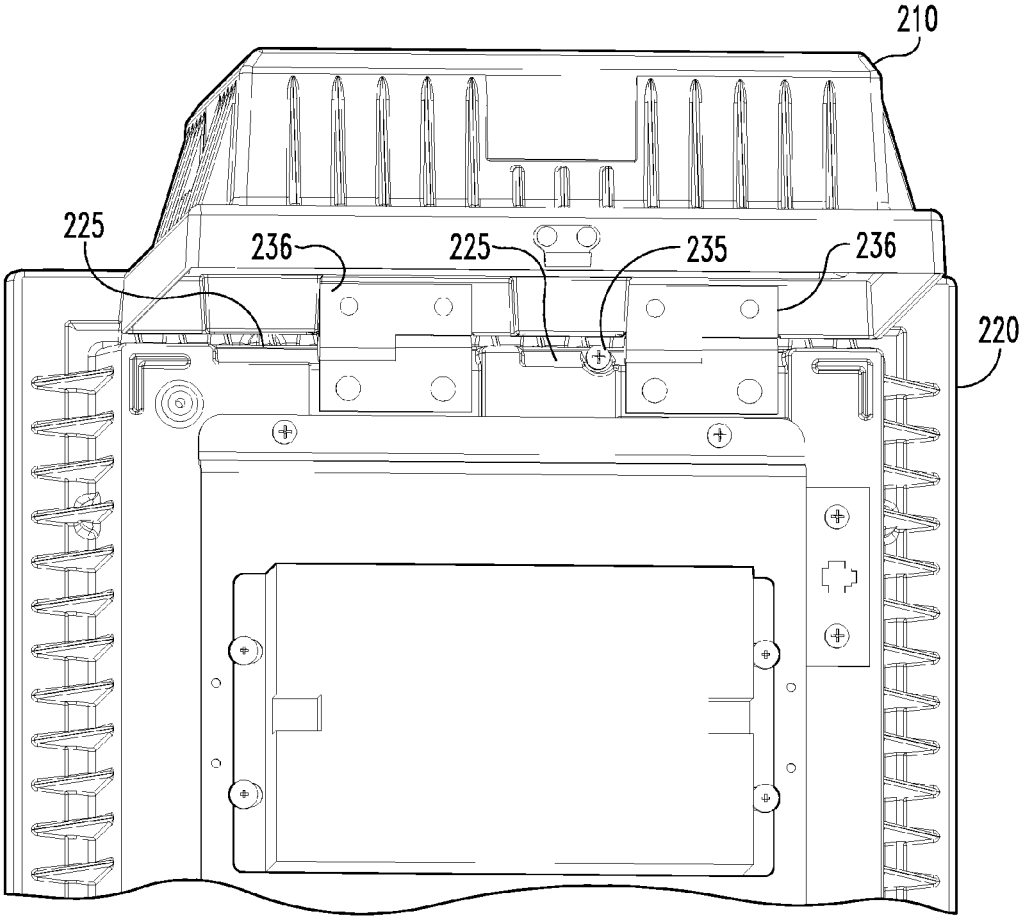
FIG. 8 shows a partial top view of a convertible lighting fixture according to an embodiment of the present disclosure with the upper housing in the open configuration.

The at least one hinge 236 may be a slip hinge, which enables the upper and lower housings 210, 220 to be disassembled from one another easily. As shown in FIG. 8, the lower housing 220 may have a channel 225 formed therein adjacent to each hinge 236 to provide clearance for one half of the hinge 236 to slide relative to the other half, thereby easily separating the upper housing 210 from the lower housing 220. To prevent tampering or accidentally disassembly of the hinge 236, a lock screw 235 may be attached to the lower housing 220 within the channel 225 to block the hinge from sliding and disengaging. Alternatively, the channel 225 may be formed in, and the lock screw 235 attached to, the upper housing 210 with the same effect. The channel 225 and lock screw 235 may be configured such that, when fully engaged, the lock screw 235 is flush with the surface of the channel 225, and thus the halves of hinge 236 may slide freely past one another and disengage. Moreover, by partially backing out the lock screw 235, it may interfere with the sliding halves of the hinge 236, thereby preventing its disassembly. Further, the lock screw 235 may be a security fastener with a tamper-resistant head requiring special tools to engage and disengage the lock screw 235.

Consequently, the at least one slip hinge 236 enables easy installation and maintenance of the upper housing 210 separate from the lower housing 220 with easy subsequent assembly of the housings 210, 220. For example, a single person may first secure the upper housing 210 in the desired location for the fixture 200. With the upper housing 210 prepositioned, power connections may be made to the fixture 200 before the lower housing 220, including the remaining components of the fixture 200, is attached to the prepositioned upper housing 210. Conventional lighting fixtures require a two-man installation and maintenance process with one person making connections while the other supports the weight of the fixture. Such a two-man process may be particularly difficult in wide area lighting applications where the fixtures are located high off the ground or in other difficult to reach locations.

The lens cover 260 may form a bowl-like shape with a lens flange 268 at the brim, which corresponds to the shape of the lower flange 228, a lens wall 264 forming the sides of the bowl-like shape, and a lens bottom 262 that extends between and caps the lens wall 264 to form the bottom of the bowl-like shape. The lens bottom 262 and the lens wall 264 define a lamp compartment 241. The lens flange 268 is formed to engage the lower housing 220 and may be reversibly attached to the lower housing 220 by any suitable means, including but not limited to screws 231. The lens flange 268 may engage the lower housing 220 within the perimeter of the lower flange 228, thereby protecting the interface therebetween from direct exposure to the environment and minimizing potential intrusion into the fixture 200. Further, the lens wall 264 and lens bottom 262 may include a plurality of optical elements (not shown) formed therein that distribute the light output from a light source 240 into a desired light pattern. Alternatively, the lens wall 264 and lens bottom 262 may not include any optical elements formed therein, and the light output from a light source, such as a LED module 240, may be directed into a desired light pattern solely by a LED module lens 246 as described further herein. As a further alternative, the lens cover 260 may include a surface treatment, such as frosted or stippling, to provide diffusion of the light emitted from the light source 240. To enable the desired light distribution, the lens cover 260 may be made of a substantially optically transparent or at least translucent material, including but not limited to glass, cyclic olefin copolymer (COC), polymethylmethacrolate (PMMA), polycarbonate (PC), PC/PMMA composite, silicones, fluorocarbon polymers, and polyetherimide (PEI), or other suitable optical grade material.

In addition to enabling the desired light distribution, the lens cover 260 further protects the lamp compartment 241 from intrusion. Moreover, a seal 230 may be disposed between the lens cover 260 and the lower housing 220 such that, when assembled, the seal 230 prevents the intrusion of dirt, water, insects, or other foreign matter into the lamp compartment 241. The seal 230 may be made of any suitably resilient material capable of maintaining a seal between the lens cover 260 and the lower housing 220, preferably for the life of the convertible light fixture 200.

In at least one embodiment according to the present disclosure, the convertible lighting fixture 200 includes at least one LED module 240 as a light source disposed within the lamp compartment 241 and reversibly attached to a mounting plate 232, which in turn is attached to the lower housing 220. The mounting plate 232 may include a reflective surface on the side facing the LED module 240 capable of effectively reflecting incident light from the LED module 240.

Referring to FIG. 7, the at least one LED module 240 may include a heat sink 244 and at least one LED 242 mechanically and thermally attached to a distal end of the heat sink 244. The LED module 240 may further include a lens 246 attached to the heat sink 244 at or near the same end as the LED 242. The heat sink 244 functions to transfer heat away from the at least one LED 242 to the remainder of the fixture 200 and to the ambient environment. The heat sink 244 may include a channel 245 formed therethrough from end to end that enables a means of electrical connection 248 to pass from the LED 242 to the opposite end of the heat sink 244. The means of electrical connection 248 may include stranded copper wires soldered or otherwise electrically connected to the LED 242 at one end and capped with terminals (not shown) and a connector 249 at the other. The connector 249 may be a type that is either sealed (i.e., waterproof) or unsealed. The heat sink 244 may further include a threaded quarter-turn attachment formed at an opposite, proximal end that enables the heat sink 244 to be reversibly attached to the mounting plate 232 with only a 90° rotation of the heat sink 244 relative to the mounting plate 232. Alternatively, the heat sink 244 may enable attachment to the mounting plate with a 90°-360° rotation. Further, the heat sink 244 is made of a material that readily conducts heat, such as steel, copper, aluminum, or other suitably conductive material, and may be manufactured by casting, forging, molding, machining, or other suitable process. In at least one embodiment, the heat sink 244 may also include a plurality of grooves around its periphery to define cooling fins therebetween, thereby improving heat transfer between the heat sink 244 and the lamp compartment 241.

In at least one embodiment of the present disclosure, the at least one LED 242 includes a semiconductor chip in thermal and electrical contact with a circuit board (not shown), the chip having a light emitting p-n junction for generating light, an electrically isolated metal base or slug, a bottom surface that may be in contact with, or coated with, a reflective material to reflect generated light upward, and a means of electrical connection to the circuit board. In at least one embodiment of the present disclosure, the at least one LED 242 is a high-output white light LED, such as the XP-G LED manufactured by Cree, Inc™. However, many possible LED light sources are operable in the system, including, but not limited to, Cree™ CXA and MLE products. The at least one LED 242 is in thermal contact with the heat sink 244, to which the LED 242 is fixed by any suitable means of attachment, such as at least one machine screw, a thermally conductive adhesive, or similar means.

The lens 246 may be formed in two halves joined together with a plurality of optical elements 247 formed therein. The lens 246 may be further configured to enable the two halves to be the same part with an indexing feature to ensure proper alignment of the halves. Consequently, the lens halves may be molded or cast in the same mold or, alternatively, manufactured using the same process. The halves of the lens 246 may be secured together and held securely to the heat sink 244 by a retainer (not shown), which ensures proper positioning the optical elements 247 of the lens 246 relative to the at least one LED 242 to maximize the optical efficiency of the module 240. The retainer may be any suitable means for securing each half of the lens 246 together and to the heat sink 244, such as a metal spring-loaded clip or a plastic pull-tie. Further, the lens 246 is made of a substantially optically transparent, or at least translucent material, including but not limited to glass, cyclic olefin copolymer (COC), polymethylmethacrolate (PMMA), polycarbonate (PC), PC/PMMA composite, silicones, fluorocarbon polymers, and polyetherimide (PEI), having an index of refraction ranging from between about 1.35 to about 1.7. In at least one embodiment, the index of refraction may be about 1.53 but may be higher or lower based on the material selected for a given embodiment. The volume of space within the lens 246 is composed of ambient air, having an index of refraction of approximately 1.0003.

In at least one embodiment according to the present disclosure, the convertible lighting fixture 200 includes an isolation plate 234 and a LED driver 250 mounted within the driver compartment 211 as shown in FIG. 7. The isolation plate 234 includes a flat portion **234*a*, upon which the driver 250 is attached, and at least two base portions 234*b* offset at a distance from the flat portion 234*a*. The base portions 234*b* may be attached to the mounting surface 222 of the lower housing 220 such that an insulating air gap exists between the flat portion 234*a* where the driver 250 may be attached and the mounting surface 222. Thus, the isolation plate 234 serves to thermally isolate the driver 250 from the lower housing 220** and thereby the LED module 240. The isolation plate 234 and the driver 250 may be attached by any suitable means including but not limited to screws 231.

The LED driver 250 includes solid state electronic circuitry to provide the proper operating current to power the at least one LED module 240. The driver 250 may include a power transformer function to convert the main power supply input from high voltage alternating current to low voltage direct current and a current regulator function to ensure the at least one LED module 240 is supplied with a constant source current. However, a by-product of the driver function is heat generated by the electronics during operation. The driver 250 is electrically connected to a power supply line (not shown) and to the at least one connector 249 of the at least one LED module 240 via a wiring harness (not shown), which passes from the driver compartment 211 through an opening 223 in the mounting surface 222 of the lower housing 220 into the insulating compartment 221 where the at least one connector 249 is disposed.

In operation, the convertible lighting fixture 200, like the fixture 100, may be mounted in a desired location by attaching the upper housing 210 at top surface 212 by any suitable means, such as screws, to a ceiling, wall, or other desired surface and connecting an electrical power supply line to the input of the driver 250. Power to the fixture 200 may be controlled manually via a wall switch or automatically via a photosensor located on the fixture 200 or a centrally-located photosensor that controls a bank of fixtures 200.

Servicing the fixture 200, whether for maintenance or replacement of individual components, proceeds as described herein relative to the fixture 100 and provides the same accompanying benefits. As with the fixture 100, the separate driver and lamp compartments 211, 241 of the fixture 200 enable ease of maintenance and robust reliability against the intrusion of foreign matter into the lamp compartment 241.

Thermal management of the heat generated by the at least one LED 242 and the LED driver 250 is critical in the fixture 200. LEDs are highly sensitive to heat and can be damaged by operating near or above the rated maximum junction temperature of the LED 242. Consequently, by its construction, the fixture 200 includes the same thermal management features and accompanying benefits as described relative to the fixture 100, including separation of the lamp, insulating, and driver compartments 241, 221, and 211, respectively. Moreover, the thermal connection between the mounting plate 232 and the lower housing 220 may be enhanced with the addition of a thermally conductive tape (not shown) to reduce the thermal resistance at the mating interface between the mounting plate 232 and the lower housing 220. Further, as noted herein, each LED module 240 has its own heat sink 244 in thermal connection with the mounting plate 232 to provide a direct thermal path away from the LED 242. In at least one embodiment, the mounting plate 232 may be thicker than the mounting plate 132, may include a greater thermal capacitance, and thus provide greater thermal management for the more heat sensitive LED module 240.

Otherwise, the fixture 200 is constructed, as the fixture 100, to conduct heat away from the light source and transfer that heat to the ambient environment via thermally conductive component materials, a continuous thermal path from the LED 242 to the exterior surface of the fixture 200, the inclusion of vertical cooling fins 216 formed in the upper housing 210 and similar vertical cooling fins 226 formed in the lower housing 220, and a total mass of the fixture 200 with a significant thermal capacitance to absorb and sink a considerable amount of thermal energy, thereby retarding increased temperatures at the LED 242. As a result, the fixture 200 is capable of dissipating the heat generated by the at least one LED 242 and the driver 250, which can then be maintained within appropriate operating temperatures in service.

According to at least one embodiment of the present disclosure, the convertible light fixture 100 may be easily converted into the fixture 200 by replacing a few components of the fixture 100 for corresponding components of the fixture 200. For example, the ballast 150 may be replaced by the LED driver 250. Likewise, the fluorescent light source 240 may be replaced by one or more LED modules 240. Moreover, because the fluorescent light source 240 inherently produces a different light distribution than the at least one LED module 240 and because each LED module 240 includes a separate lens 246 with the plurality optical elements 247, the lens cover 160 may be replaced by the lens cover 260. Alternatively, the lens cover 160 may be configured to enable a desired light distribution regardless of whether the light source 140 or the LED module 240 is used, whereby the lens cover 160 need not be replaced to convert to fixture 200. Further, the mounting plate 132 may be replaced by the mounting plate 232. Alternatively, the mounting plate 132 may be configured to enable attachment of either light source 140 or LED module 240 such that the mounting plate 132 need not be replaced to convert to fixture 200. Nonetheless, the remaining components of fixture 100, including the upper housing 110, the isolation plate 134, the lower housing 120, the seal 130 and all means of attachments, such as screws 131, need not be replaced when converting from fixture 100 to fixture 200. As a result, the fixture 100 may be converted into the fixture 200 without removing the fixture 100 from its mounting location, thereby facilitating maintenance, retrofitting, or upgrade of the convertible lighting fixtures 100, 200 and lowering the total life-cycle cost of operation.

A further advantage of the convertible lighting fixture 200 is the ability to replace individual LED modules 240 without the need to replace an entire array of LEDs. The singular replaceability of the LED module 240 is enabled by the threaded quarter-turn attachment with the mounting plate 232 and by the easily disengaged and re-engaged connector 249. Consequently, should a LED module 240 need to be replaced for any reason, that particular LED module 240 may be easily removed from the fixture 200 and a new one installed in its place as simply as changing a conventional incandescent light bulb. Besides replacing a failed LED module 240, the ease of replacement enables a given fixture 200 to be easily and cost-effectively upgraded to the latest LED technology. As described herein, the efficacy of LEDs is continually improving, as measured by light output per Watt of electrical power input. Consequently, an operator may wish to replace an older LED module 240 with one using a newer more efficient LED 242 even though the original LED module 240 has not failed. Thus, the singular replaceability of the LED module 240 enables an operator to continually upgrade the fixture 200 to the latest LED technology without the cost and labor of replacing the entire fixture 200.

While various embodiments of a convertible lighting fixture have been described in considerable detail herein, the embodiments are merely offered by way of non-limiting examples of the disclosure described herein. For example, though various components of a convertible lighting fixture have been depicted to be generally square-shaped in the plan view, these components could have other general shapes such as circular, hexagonal, or other suitable or desire shape. As another example, the light sources disclosed with respect to the convertible lighting fixture include induction fluorescent and LED lamps. Nonetheless, the convertible lighting fixture may be configured to convert to any lighting system that uses a light source and associated power electronics. It will therefore be understood that various changes and modifications may be made, and equivalents may be substituted for elements thereof, without departing from the scope of the disclosure and are intended to encompass any later appended claims. Indeed, this disclosure is not intended to be exhaustive or to limit the scope of the disclosure.

Further, in describing representative embodiments, the disclosure may have presented a method and/or process as a particular sequence of steps. However, to the extent that the method or process does not rely on the particular order of steps set forth herein, the method or process should not be limited to the particular sequence of steps described. Other sequences of steps may be possible. Therefore, the particular order of the steps disclosed herein should not be construed as limitations of the present disclosure. Such sequences may be varied and still remain within the scope of the present disclosure.

The invention claimed is:

1. A lighting fixture, the lighting fixture comprising:

a first housing defining a first compartment;

a second housing defining a second compartment and movably and removably attached to the first housing, the second housing having a surface adjacent the first compartment; and a cover reversibly attached to the second housing opposite the first housing, the cover defining a third compartment thermally insulated from the first compartment by the second compartment.

2. The lighting fixture of claim 1, the lighting fixture further comprising:

a plate attached to the second housing and at least partially separating the second compartment from a third compartment; and a light source mechanically attached to the plate and electrically connected to a power source disposed within the first compartment.

3. The lighting fixture of claim 1, wherein the first, second, and third compartments are configured to enable the light source within the third compartment to be replaced without accessing the first or second compartments.

4. The lighting fixture of claim 1, wherein the first, second, and third compartments are configured to enable the power source within the first compartment to be replaced without accessing the second or third compartments.

5. The lighting fixture of claim 1, the lighting fixture further comprising at least one slip hinge, removably attaching the first and second housings, and a locking screw attached to either the first or second housings and disposed adjacent the at least one slip hinge, whereby the locking screw prevents disassembly of the slip hinge.

6. The lighting fixture of claim 1, wherein the cover comprises a plurality of optical elements capable of directing light emitted by the light source into a desired light distribution.

7. The lighting fixture of claim 1, wherein the plate is adapted to enable the attachment of different types of light sources.

8. The lighting fixture of claim 1, wherein the light source is a fluorescent induction tube disposed within at least one induction coil.

9. The lighting fixture of claim 8, wherein the power source is a ballast.

10. The lighting fixture of claim 1, wherein the light source is at least one light-emitting diode module.

11. The lighting fixture of claim 10, wherein the power source is a light-emitting diode driver, including voltage and current control.

12. A convertible lighting fixture, the convertible lighting fixture comprising:

a first housing defining a first compartment;

a second housing defining a second compartment and movably and removably attached to the first housing, the second housing having a surface adjacent the first compartment;

a mounting plate attached to the second housing and at least partially separating the second compartment from a third compartment;

a light source mechanically attached to the mounting plate and electrically connected to a power source disposed within the first compartment; and a cover defining the third compartment thermally insulated from the first compartment by the second compartment and substantially surrounding the light source, the cover reversibly attached to the second housing opposite the first housing;

wherein the first, second, and third compartments are configured to enable the power source within the first compartment to be replaced without accessing the second or third compartments.

13. The convertible lighting fixture of claim 12, wherein the mounting plate is adapted to enable the attachment of different types of light sources.

14. The convertible lighting fixture of claim 12, wherein the first, second, and third compartments are configured to enable the light source within the third compartment to be replaced without accessing the first or second compartments.

15. The convertible lighting fixture of claim 12, wherein the light source is a fluorescent induction tube disposed within at least one induction coil.

16. The convertible lighting fixture of claim 15, wherein the power source is a ballast.

17. The convertible lighting fixture of claim 12, wherein the light source is at least one light-emitting diode module.

18. The convertible lighting fixture of claim 17, wherein the power source is a light-emitting diode driver, including voltage and current control.

19. The convertible lighting fixture of claim 12, the convertible lighting fixture further comprising an isolation plate attached to the surface of the second housing and disposed within the first compartment, wherein the power source is attached to the isolation plate.

20. The convertible lighting fixture of claim 12, further comprising at least one slip hinge, removably attaching the first and second housings, and a locking screw attached to either the first or second housings and disposed adjacent the at least one slip hinge, whereby the locking screw prevents disassembly of the slip hinge.

* * * * *